US008128084B2

(12) United States Patent
Kitayama

(10) Patent No.: US 8,128,084 B2
(45) Date of Patent: Mar. 6, 2012

(54) IMAGE FORMING APPARATUS

(75) Inventor: Kunihiko Kitayama, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 56 days.

(21) Appl. No.: 12/708,802

(22) Filed: Feb. 19, 2010

(65) Prior Publication Data

US 2010/0213663 A1 Aug. 26, 2010

(30) Foreign Application Priority Data

Feb. 26, 2009 (JP) ..... 2009-044044

(51) Int. Cl.
*B65H 1/00* (2006.01)

(52) U.S. Cl. ..... 271/171; 271/145; 271/164; 399/393

(58) Field of Classification Search ..... 271/171, 271/162, 164, 145; 399/393
See application file for complete search history.

(56) References Cited

U.S. PATENT DOCUMENTS 5,611,528 A * 3/1997 Nakamura et al. ..... 271/164
5,931,456 A * 8/1999 Laidlaw ..... 271/171

FOREIGN PATENT DOCUMENTS

JP 08-217262 8/1996

* cited by examiner

*Primary Examiner* — Michael McCullough
*Assistant Examiner* — Luis A Gonzalez
(74) *Attorney, Agent, or Firm* — Fitzpatrick, Cella, Harper & Scinto

(57) ABSTRACT

An image forming apparatus, in which a trailing edge regulation portion is moved to a position according to a sheet contained in a cassette body to regulate a position of the sheet. A positioning lever is swingably provided to the trailing edge regulation portion to be engaged with a rack tooth row provided on the cassette body. The trailing edge regulation portion is held by the positioning lever at a regulation position according to the sheet. When a force in a sliding direction is applied to the trailing edge regulation portion, the trailing edge regulation portion is moved to be brought into pressure contact with the positioning lever, thereby regulating movement in an engagement releasing direction of the positioning lever engaged with the rack tooth row.

3 Claims, 7 Drawing Sheets

IMAGE FORMING APPARATUS

BACKGROUND OF THE INVENTION

1. Field of the Invention

The present invention relates to an image forming apparatus, and more particularly, to a configuration in which a regulation portion configured to regulate a position of a sheet contained in a sheet feeding cassette is held at a regulation position.

2. Description of the Related Art

There is widely used an image forming apparatus, such as a conventional copier, printer, or facsimile, in which a sheet feeding device is provided and a sheet is fed from the sheet feeding device to an image forming portion to thereby form an image. In such a sheet feeding device, in general, a sheet feeding cassette serving as a sheet containing portion is removably mounted to an image forming apparatus main body, and a sheet contained in the sheet feeding cassette is automatically fed to the image forming portion by a sheet feeding roller.

A cassette body of the sheet feeding cassette containing the sheet is provided with a trailing edge regulation portion configured to regulate a position of an upstream edge (hereinafter, referred to as a trailing edge) in a sheet feeding direction of the contained sheet. Further, the cassette body is provided with side edge regulation portions configured to regulate side edge positions of the sheet in a direction (hereinafter, referred to as a width direction) orthogonal to the sheet feeding direction.

When the sheet is contained in the sheet feeding cassette, the side edge regulation portions regulate the side edge positions of the sheet, whereas the trailing edge regulation portion regulates the trailing edge of the sheet. Accordingly, a leading edge position of the sheet is always regulated to be located at a predetermined position at which sheet feeding is possible. With this configuration, when the sheet feeding cassette is mounted to the image forming apparatus main body, it is possible to perform stable sheet feeding regardless of a sheet size.

Incidentally, in such a sheet feeding cassette, there is widely known a sheet feeding cassette in which the trailing edge regulation portion and the side edge regulation portions are slidably provided to the cassette body in order to easily perform switching of a position of the trailing edge regulation portion and positions of the side edge regulation portions according to the sheet size. In the sheet feeding cassette having the above-mentioned configuration, in order to set and hold the position of the trailing edge regulation portion and the positions of the side edge regulation portions, the trailing edge regulation portion, the side edge regulation portions, and the cassette body are provided with rack claws or engagement teeth formed at a constant fine pitch. By engaging the rack claws of the trailing edge regulation portion and the rack claws of the side edge regulation portions with the rack claws of the cassette body, the position of the trailing edge regulation portion and the positions of the side edge regulation portions are determined. By releasing engagement between the rack claws, changing of the positions of the regulation portions (switching of the sheet size) is possible. The above-mentioned configuration is disclosed in Japanese Patent Application Laid-Open No. H08-217262.

However, in the image forming apparatus and the sheet feeding device provided with the above-mentioned conventional sheet feeding cassette, there is a problem in that the position of the trailing edge regulation portion and the positions of the side edge regulation portions are misaligned (moved out of alignment with proper positions) due to an impact applied when the sheet feeding cassette is inserted into the apparatus main body. When the positions of the side edge regulation portions are misaligned, the position of the sheet is misaligned, and thus right and left margins are different in width upon image formation, with the result that image quality is deteriorated. Further, when the position of the trailing edge regulation portion is misaligned, a proper positional relation is not established between the leading edge of the sheet and the sheet feeding roller, and thus sheet feeding failure such as a sheet jam or a miss feed occurs.

SUMMARY OF THE INVENTION

According to the present invention, an image forming apparatus comprising: a sheet feeding cassette removably mounted to an apparatus main body, and configured to contain sheets; a sheet feeding member configured to feed a sheet from the sheet feeding cassette; and an image forming portion configured to form an image on the sheet fed out from the sheet feeding member, wherein the sheet feeding cassette includes: a regulation portion slidably provided in a cassette body, and configured to regulate a position of the sheet by the regulation portion being moved to a position according to a size of the sheet contained in the cassette body; and a fixation mechanism configured to fix the regulation portion, and wherein the fixation mechanism includes: a tooth row provided on the cassette body along a sliding movement direction of the regulation portion; a holding member movably provided on the regulation portion to be engaged with the tooth row, wherein the regulation portion and the holding member are relatively movable in the sliding movement direction of the regulation portion; and a stopper portion provided to the regulation portion, configured to regulate a movement of the holding member by pressing the holding member when a force in the sliding movement direction is applied to the regulation portion.

Further features of the present invention will become apparent from the following description of exemplary embodiments with reference to the attached drawings.

DESCRIPTION OF THE EMBODIMENTS

In the following, an embodiment for carrying out the present invention is described in detail with reference to the drawings.

Figure 1:
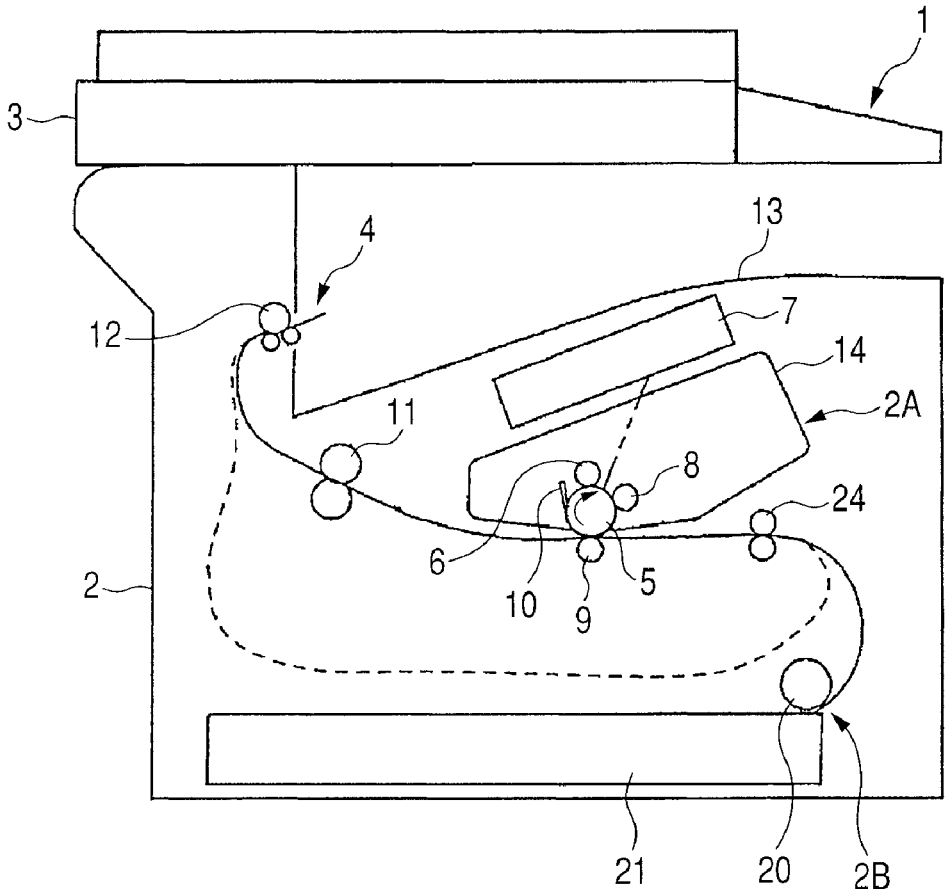
FIG. 1 is a schematic view illustrating a configuration of a printer as an example of an image forming apparatus according to an embodiment of the present invention.

FIG. 1 is a schematic view illustrating a configuration of a printer as an example of an image forming apparatus according to the embodiment of the present invention.

FIG. 1 illustrates a printer 1 and a printer main body 2. On an upper portion of the printer main body 2, there is provided an image reading portion 3 which emits light onto an original placed on a platen glass serving as an original placement table and which includes an image sensor configured to convert the reflected light into a digital signal. Further, the printer main body 2 includes an image forming portion 2A, and is provided with a sheet feeding device 2B configured to feed a sheet to the image forming portion 2A.

The image forming portion 2A includes a process cartridge 14 including a photosensitive drum 5 serving as an image bearing member, a charging roller 6 configured to charge the photosensitive drum 5 primarily, a developing device 8, and a cleaning device 10. Further, the image forming portion 2A includes a laser scanner 7 serving as an exposure unit configured to expose a surface of the photosensitive drum 5 with light to form an electrostatic latent image on the photosensitive drum. The sheet feeding device 2B includes a sheet feeding cassette 21 serving as a sheet containing portion removably mounted to the printer main body 2 doubling as a sheet feeding device main body, and a pickup roller 20 serving as a sheet feeding member configured to send out sheets stacked in the sheet feeding cassette 21 from the top of the stack.

FIG. 1 illustrates a transfer roller 9 brought into contact with the photosensitive drum 5 to constitute a transferring portion together with the photosensitive drum 5, a fixing portion 11 configured to fix to the sheet a toner image transferred at the transferring portion, and a sheet discharging portion 4 configured to discharge the sheet having the toner image fixed thereon to a sheet discharging tray 13.

Next, an image forming operation in the printer 1 having the above-mentioned configuration will be described.

When the image forming operation is started, the photosensitive drum 5 first rotates in a direction indicated by the arrow in FIG. 1, and the surface of the photosensitive drum 5 is charged by the charging roller 6. Then, laser light is emitted from the laser scanner 7 to the photosensitive drum 5 based on image information. In this manner, the electrostatic latent image is formed on the photosensitive drum. Next, the electrostatic latent image is developed by the developing device 8 to be visualized as a toner image. After that, remaining toner on the photosensitive drum 5 is removed by the cleaning device 10, and remaining charges on the photosensitive drum 5 are eliminated by a charge eliminator (not shown).

Meanwhile, the pickup roller 20 rotates in tandem with such a toner image forming operation, and sends out the top sheet stacked on the sheet feeding cassette 21. Further, the sheet thus sent out by the pickup roller 20 is then subjected to leading-edge positioning (skew feed correction) at a stopping registration roller pair 24. Next, the sheet is conveyed to the transferring portion by the registration roller pair 24 in synchronization with timing in which the image is formed on the photosensitive drum 5 in the image forming portion 2A, and the image formed on the photosensitive drum 5 is transferred onto the sheet by the transfer roller 9.

Next, the sheet onto which the toner image is thus transferred is conveyed to the fixing portion 11. At the fixing portion 11, an unfixed toner image is heated and pressed so as to be fixed onto a surface of the sheet. The sheet after being thus subjected to fixing of the toner image is discharged by a sheet discharging roller 12 onto the sheet discharging tray 13 constituting a bottom surface of an in-body sheet discharging portion provided between an upper surface of the printer main body and the image reading portion 3.

Figure 2:
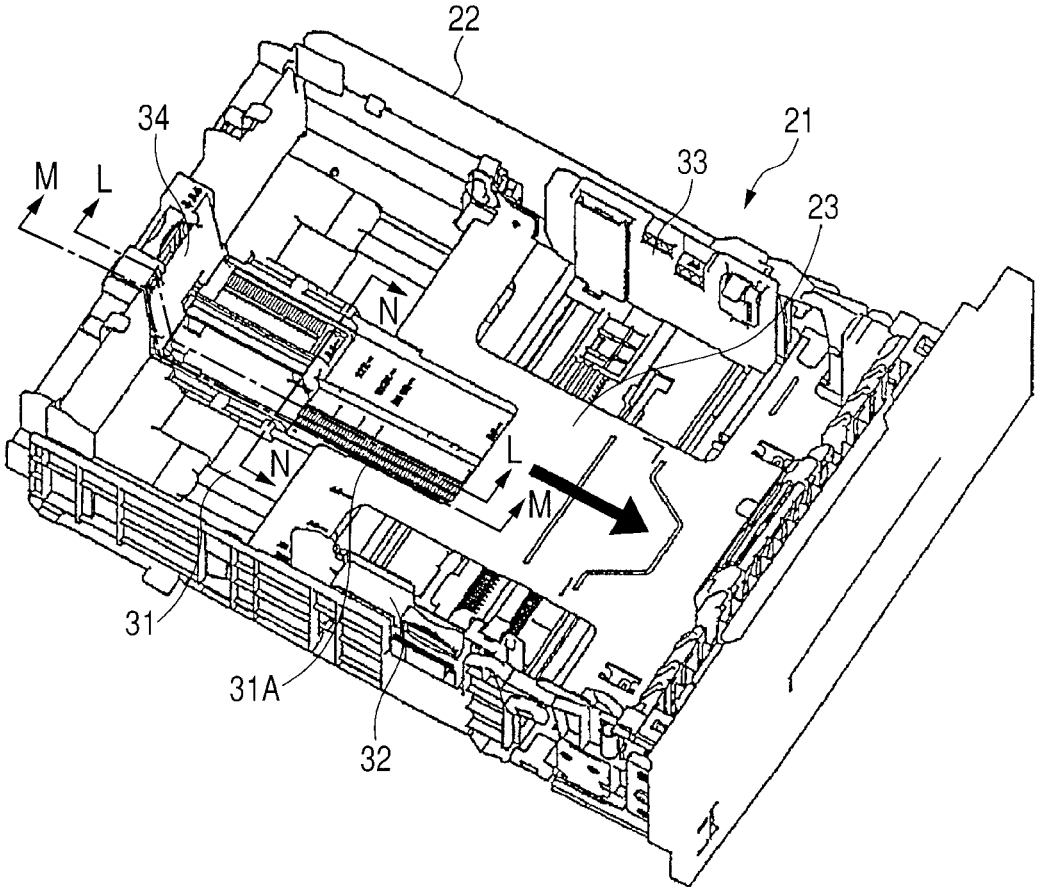
FIG. 2 is a perspective view illustrating a configuration of a sheet feeding cassette provided in a sheet feeding device.

Incidentally, as illustrated in FIG. 2, the sheet feeding cassette 21 includes a cassette body 22 forming a sheet containing space in which sheets of various sizes are stacked and contained, and an intermediate plate 23 which is provided in the cassette body 22 to be pivotable in an up-down direction and stacks the sheets thereon. The intermediate plate 23 is provided to be movable upward and downward by a pivot mechanism (not shown). Further, the sheet feeding cassette 21 includes side regulation portions 32 and 33 serving as a pair of width-direction regulation portions configured to regulate both side edge positions of the sheet in a width direction orthogonal to a sheet feeding direction, and a trailing edge regulation portion 34 configured to regulate a trailing edge position of the sheet.

Here, the side regulation portions 32 and 33 and the trailing edge regulation portion 34 are configured to be slidable according to a sheet size. The side regulation portions 32 and 33 move by the same amount in opposite directions to each other by a rack and a pinion (not shown). The side regulation portions 32 and 33 are caused to move by the same amount in the opposite directions to each other in this manner, and thus both the side regulation portions can be moved by operating one of the side regulation portions. Further, the trailing edge regulation portion 34 is movable in parallel to the sheet feeding direction indicated by the thick arrow of FIG. 2.

When the sheets of various sizes are contained in the cassette body of the above-mentioned sheet feeding cassette 21, the side regulation portions 32 and 33 are brought into contact with side edges of the sheet to define the side edge positions of the sheet, and the trailing edge regulation portion 34 is brought into contact with a trailing edge of the sheet to define the trailing edge position of the sheet. In this manner, the sheet can be contained while being positioned.

For feeding the sheet, after the sheet feeding cassette 21 is removably mounted into the printer main body in the same direction as the sheet feeding direction, the intermediate plate 23 is pivoted upward by a pivot mechanism (not shown). In this manner, the sheet positioned by the side regulation portions 32 and 33 and the trailing edge regulation portion 34 is pressed against the pickup roller 20. The sheet thus pressed against the pickup roller 20 is sent out one by one owing to sending action of the pickup roller 20 to be conveyed to an image forming portion.

Figure 3:
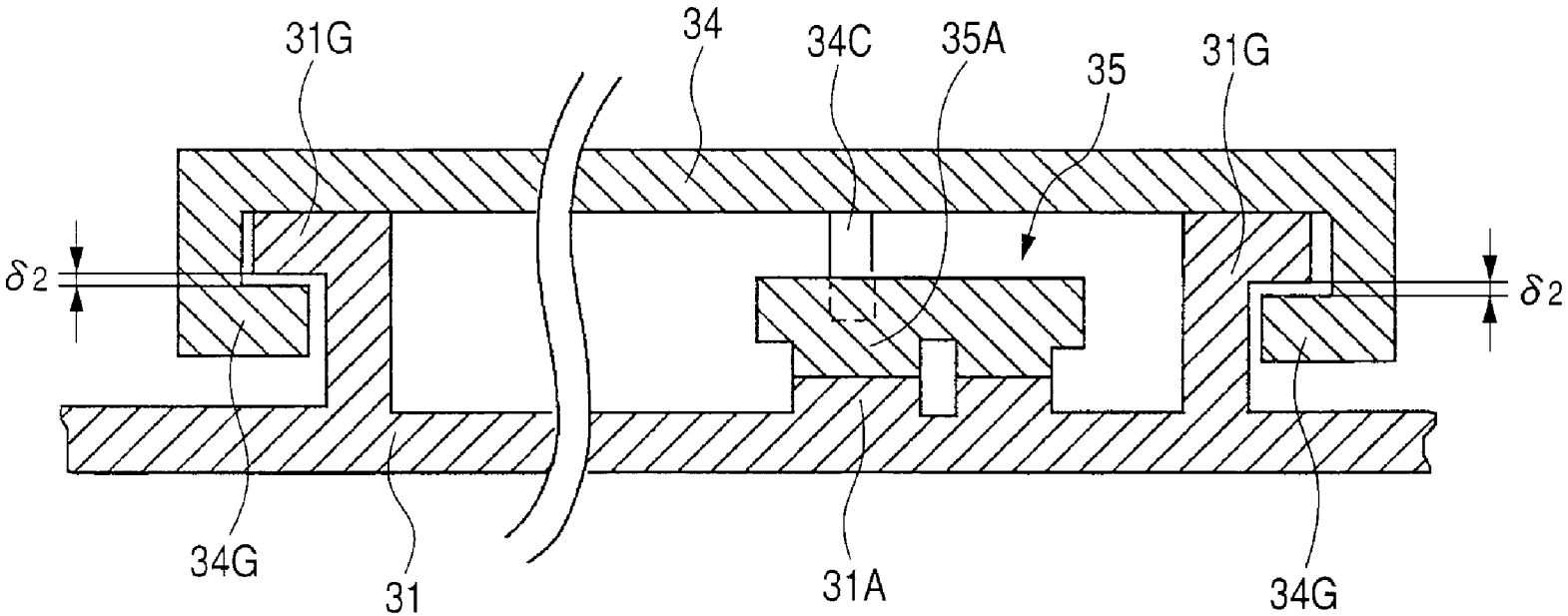
FIG. 3 is a sectional view taken along the line N-N of FIG. 2, which illustrates the configuration of the sheet feeding cassette.

Incidentally, as illustrated in FIG. 3, in the trailing edge regulation portion 34, there are formed engagement portions 34G on both end portions in the width direction of the trailing edge regulation portion 34, respectively. By engaging the engagement portions 34G with two guides 31G which are provided on a bottom surface 31 of the cassette body 22 so as to protrude therefrom and extend in the sheet feeding direction, the trailing edge regulation portion 34 is movable in the sheet feeding direction.

Figure 4:
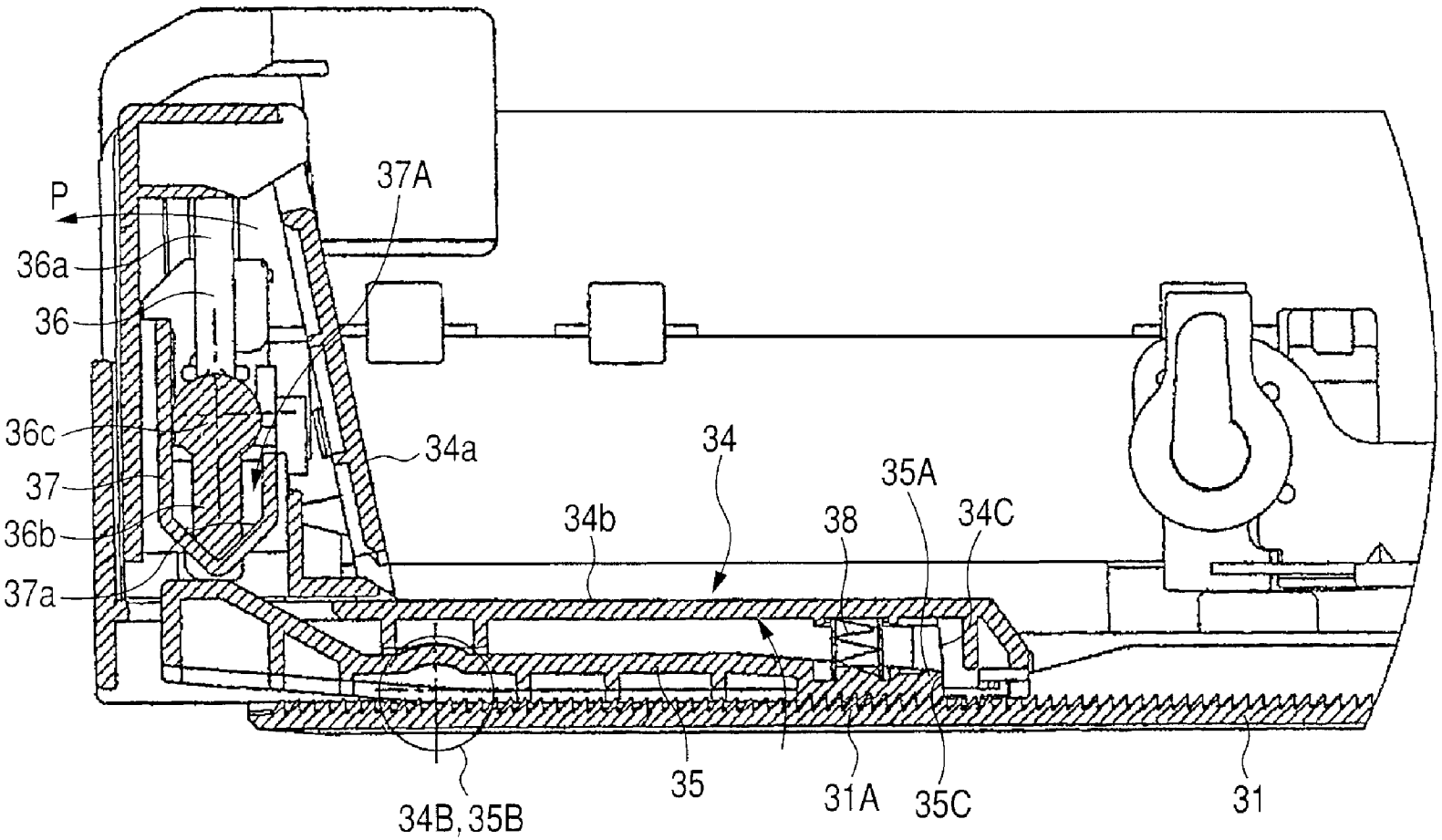
FIG. 4 is a sectional view taken along the line M-M of FIG. 2, which illustrates the configuration of the sheet feeding cassette.
Figure 5:
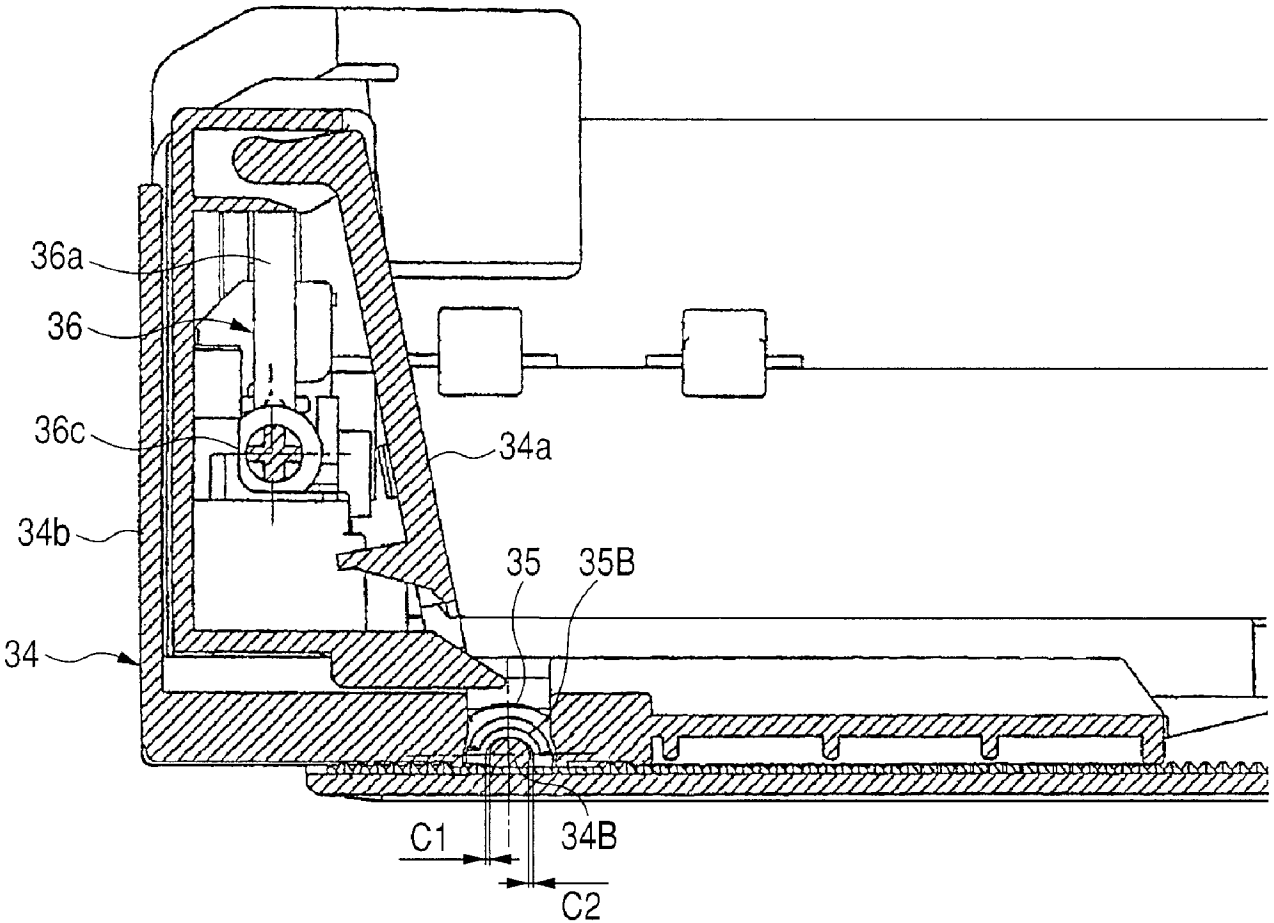
FIG. 5 is a sectional view taken along the line L-L of FIG. 2, which illustrates the configuration of the sheet feeding cassette.

Further, as illustrated in FIGS. 4 and 5, the trailing edge regulation portion 34 includes a main body portion 34*b* provided with an abutment portion 34*a*, which is brought into contact with the trailing edge of the sheet, and an operation lever 36 serving as an operation portion to be operated when the trailing edge regulation portion 34 is moved. In addition, the trailing edge regulation portion 34 includes a positioning lever 35 serving as a swingable holding member configured to hold the trailing edge regulation portion 34 at a trailing edge regulation position by disengagably engaging with the bottom surface 31 of the cassette body 22.

Figure 6A:
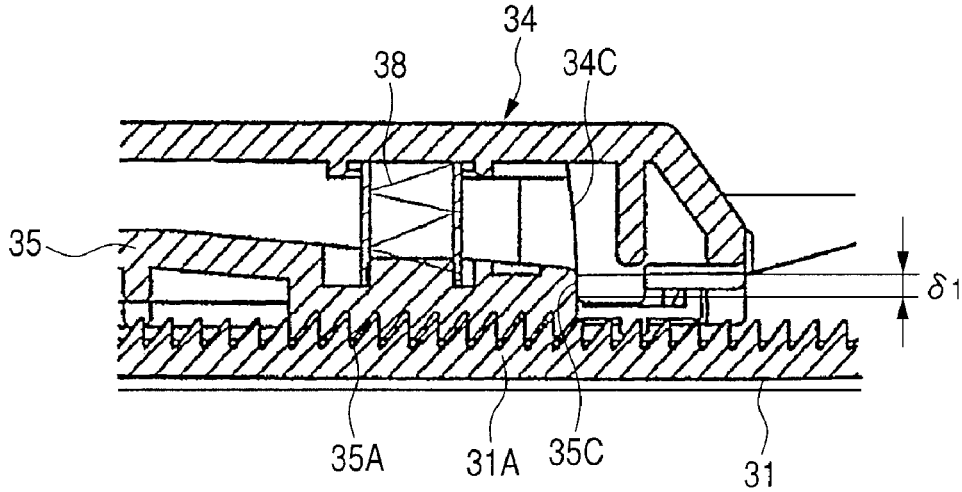
FIGS. 6A and 6B are sectional views illustrating a main part of the configuration of the sheet feeding cassette.
Figure 6B:
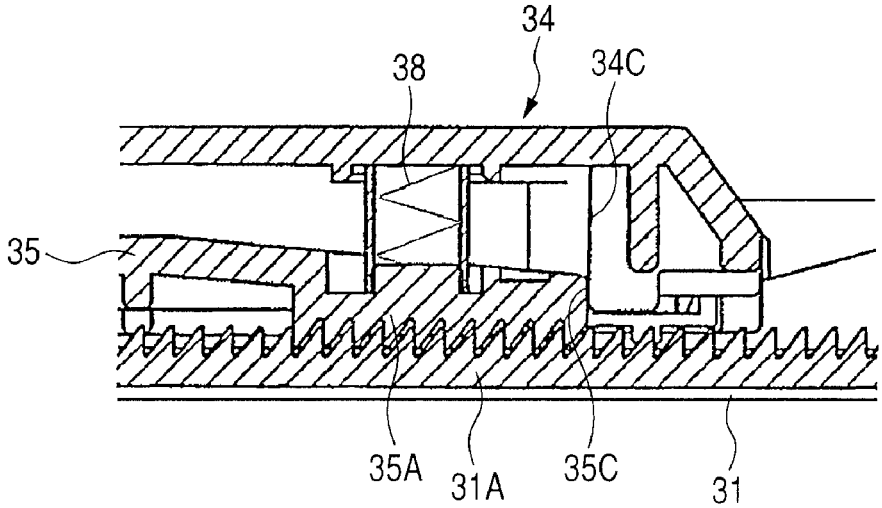

As illustrated in FIGS. 6A and 6B, on the bottom surface of one swing end portion of the positioning lever 35, the positioning lever 35 includes a tooth row 35A formed of multiple triangular teeth. Further, on the bottom surface 31 of the cassette body 22, there is provided a rack tooth row 31A serving as an engagement portion formed of triangular teeth. As illustrated in FIG. 2, the rack tooth row 31A is arranged on the bottom surface of the cassette body 22 along the sheet feeding direction.

Normally, by engaging (meshing) the tooth row 35A of the positioning lever 35 with the rack tooth row 31A provided on the bottom surface 31 of the cassette body 22, the positioning lever 35 is engaged with the cassette body 22, and the trailing edge regulation portion 34 is held at the regulation position according to the sheet size. In this embodiment, (the tooth row 35A of) the positioning lever 35 and the rack tooth row 31A provided on the bottom surface 31 of the cassette body 22 constitute a fixation mechanism configured to hold the trailing edge regulation portion 34 to the cassette body 22 in the regulation position according to the sheet size.

Further, by forming the teeth of the tooth row 35A of the positioning lever 35 and the teeth of the rack tooth row 31A of the cassette body 22 into triangular shapes as described above, it is possible to ensure high holding strength in a mechanical point of view. As a result, a pitch of the teeth of the tooth row 35A of the positioning lever 35 and a pitch of the teeth of the rack tooth row 31A provided on the bottom surface 31 of the cassette body 22 can be reduced, and hence it is possible to finely adjust the regulation position of the trailing edge regulation portion 34.

Incidentally, in this embodiment, as illustrated in FIG. 5, a swing center portion 35B of the positioning lever 35 is engaged with a lever supporting portion 34B of the trailing edge regulation portion 34. With this configuration, the positioning lever 35 is swingable about the swing center portion 35B with respect to the trailing edge regulation portion 34. As illustrated in FIG. 4, a compression spring 38 is arranged between the positioning lever 35 and the trailing edge regulation portion 34. The compression spring 38 biases the positioning lever 35 downward, and thus the tooth row 35A of the positioning lever 35 is meshed with the rack tooth row 31A of the cassette body 22.

Meanwhile, when the trailing edge regulation portion 34 is moved, the positioning lever 35 is caused to swing, and then engagement between the tooth row 35A of the positioning lever 35 and the rack tooth row 31A of the cassette body 22 is released. In order to cause the positioning lever 35 to swing in this manner, the operation lever 36 is operated. Here, the operation lever 36 is held by the main body portion 34*b* of the trailing edge regulation portion 34 so as to be swingable about a swing center 36*c*.

Further, an intermediate member 37 is provided between the operation lever 36 and the swing end portion of the positioning lever 35 on the operation lever side with respect to the swing center portion 35B. The intermediate member 37 is supported so as to be slidable with respect to the main body portion 34*b* of the trailing edge regulation portion 34 in upward and downward directions, and is biased by a spring (not shown) in the upward direction. Further, at a lower end portion of the intermediate member 37, there is provided a concave portion 37A with tapered inner wall surfaces 37*a*, which allows a lower portion 36*b* of the operation lever 36 to enter the concave portion 37A and which constitutes a cam portion for lowering the intermediate member 37 depending on the operation of the operation lever 36.

For moving the trailing edge regulation portion 34, an upper portion 36*a* of the operation lever 36 is moved by a user's finger in a direction indicated by an arrow P of FIG. 4 (leftward). Then, the operation lever 36 swings about the swing center 36*c*, and thus the lower portion 36*b* of the operation lever 36 is moved rightward in FIG. 4. In addition, when the lower portion 36*b* of the operation lever 36 is moved in this manner, the lower portion 36*b* of the operation lever 36 presses one of the inner wall surfaces 37*a* of the concave portion 37A of the intermediate member 37. In association with the pressing, the intermediate member 37 is lowered against a spring (not shown). That is, swinging movement of the operation lever 36 is converted into upward-downward movement of the intermediate member 37.

When the intermediate member 37 is lowered as described above, the swing end portion of the positioning lever is pressed, and the positioning lever 35 swings about the swing center portion 35B in a counterclockwise direction. Accordingly, the engagement between the tooth row 35A of the positioning lever 35 and the rack tooth row 31A of the cassette body 22 is released. In this manner, the trailing edge regulation portion 34 can be moved. The trailing edge regulation portion 34 can be moved to the position according to the sheet size.

When the user's finger is moved away from the operation lever 36 after the trailing edge regulation portion 34 is moved as described above, no force to press the intermediate member 37 downward is applied, and hence the intermediate member 37 is raised by the spring (not shown). In association with the raising, the positioning lever 35 swings in a clockwise direction. Accordingly, the tooth row 35A of the positioning lever 35 is engaged with the rack tooth row 31A of the cassette body 22, and the trailing edge regulation portion 34 is locked.

Meanwhile, in a case where the upper portion 36*a* of the operation lever 36 is moved in a direction opposite to the direction indicated by the arrow P of FIG. 4, the operation lever 36 swings about the swing center 36*c*, and thus the lower portion 36*b* of the operation lever 36 is moved leftward in FIG. 4. Accordingly, the lower portion 36*b* of the operation lever 36 presses the other inner wall surface 37*a* of the concave portion 37A of the intermediate member 37. In association with the pressing, the intermediate member 37 is lowered against the spring (not shown).

When the intermediate member 37 is lowered as described above, the swing end portion of the positioning lever is pressed, and the positioning lever 35 swings about the swing center portion 35B in the counterclockwise direction. Accordingly, the engagement between the tooth row 35A of the positioning lever 35 and the rack tooth row 31A of the cassette body 22 is released. In this manner, the trailing edge regulation portion 34 can be moved. The trailing edge regulation portion 34 can be moved to the position according to the sheet size. As described above, regardless of an operating direction of the operation lever 36, the trailing edge regulation portion 34 can be moved by operating the operation lever 36, and hence a moving operation of the trailing edge regulation portion 34 to the position according to the sheet size is facilitated.

Incidentally, when the sheet feeding cassette 21 is inserted into the printer main body 2 after the sheet feeding cassette 21 is pulled out of the printer main body 2 and sheet supplement is performed, if an inserting operation is performed swiftly, an impact force is applied to the trailing edge regulation portion 34 as described above due to weight of the sheets stacked in the sheet feeding cassette. When the impact force is applied in this manner, if the tooth row 35A of the positioning lever 35 is detached from the rack tooth row 31A of the cassette body 22, the trailing edge regulation portion 34 is misaligned with respect to the cassette body 22.

In this embodiment, in order to prevent the positioning lever 35 from being detached from the rack tooth row 31A of the cassette body 22 due to the impact force applied at the time of inserting the sheet feeding cassette, when the impact force is applied to the trailing edge regulation portion 34, the trailing edge regulation portion 34 is brought into pressure contact with a leading end portion of the positioning lever 35. Therefore, as illustrated in FIGS. 3, 6A, and 6B, a stopper portion 34C is provided in the width direction of an end portion of the trailing edge regulation portion 34 on a downstream side in the sheet feeding direction. When the sheet feeding cassette 21 is inserted into the printer main body 2, if the trailing edge regulation portion 34 is displaced to an upstream side in the sheet feeding direction due to the weight of the sheets in the sheet feeding cassette, the stopper portion 34C is brought into pressure contact (abutment) with a leading end portion 35C of the positioning lever 35.

Here, in this embodiment, as illustrated in FIG. 5, the swing center portion 35B of the positioning lever 35 is engaged with the lever supporting portion 34B of the trailing edge regulation portion 34 with clearances C1 and C2 having constant amounts in a moving direction of the trailing edge regulation portion 34. Owing to provision of such clearances C1 and C2, the trailing edge regulation portion 34 can be moved separately from the positioning lever 35.

Thus, when the impact force in a sliding direction is applied at the time of the inserting operation of the sheet feeding cassette, the trailing edge regulation portion 34 is moved by amounts of the clearances in the direction opposite to the sheet feeding direction, and the stopper portion 34C is brought into pressure contact with the leading end portion 35C of the positioning lever 35. As described above, owing to provision of the clearances C1 and C2, in a case where a force in the direction opposite to the sheet feeding direction is applied to the trailing edge regulation portion 34, the trailing edge regulation portion 34 is moved, and the stopper portion 34C is brought into pressure contact with the leading end portion 35C of the positioning lever 35. In this embodiment, each of the clearances C1 and C2 is approximately 0.1 to 0.5 mm. By setting the clearances in this manner, a normal moving operation of the trailing edge regulation portion 34 can be performed without hindering swinging of the positioning lever 35.

When the stopper portion 34C is brought into pressure contact with the leading end portion 35C of the positioning lever 35 as described above, a frictional force acts between the stopper portion 34C and the leading end portion 35C, and hence it is possible to prevent swinging of the positioning lever 35 in the counterclockwise direction that is an engagement releasing direction. Thus, even if the impact force is applied to the trailing edge regulation portion 34 at the time of the inserting operation of the sheet feeding cassette, it is possible to prevent the tooth row 35A of the positioning lever 35 from being detached from the rack tooth row 31A of the cassette body 22, and to prevent misalignment of the trailing edge regulation portion 34 from occurring.

In this embodiment, as illustrated in FIG. 6A, an overlap δ1 in the up-down direction is provided between the stopper portion 34C of the trailing edge regulation portion 34 and the leading end portion 35C of the positioning lever 35. Incidentally, as illustrated in FIG. 3, the engagement portions 34G of the trailing edge regulation portion 34 are engaged with the two guides 31G of the cassette body 22 with a clearance δ2 in the up-down direction. Owing to provision of such clearance δ2, the trailing edge regulation portion 34 can be moved smoothly along the guides 31G, and the trailing edge regulation portion 34 can be moved in the upward direction by an amount of the clearance δ2.

Here, when the trailing edge regulation portion is moved in the upward direction, an amount of the overlap δ1 in the up-down direction between the stopper portion 34C of the trailing edge regulation portion 34 and the leading end portion 35C of the positioning lever 35 is reduced by the amount of the clearance δ2. Therefore, the amount of the overlap δ1 is set such that the stopper portion 34C is reliably brought into contact with the leading end portion 35C of the positioning lever 35 and that a difference of overlap amount (δ1-δ2) becomes a positive value, even when the trailing edge regulation portion 34 is moved in the upward direction in this manner.

As described above, in this embodiment, the trailing edge regulation portion 34 can be moved separately from the positioning lever 35. With this configuration, when the force is applied to the trailing edge regulation portion 34, the trailing edge regulation portion 34 can be moved to be brought into pressure contact with the positioning lever 35, so that the trailing edge regulation portion 34 can regulate the movement in the engagement releasing direction of the positioning lever 35 engaged with the cassette body 22. Thus, when the force is applied to the trailing edge regulation portion 34, the trailing edge regulation portion 34 is moved to be brought into pressure contact with the positioning lever 35 to regulate the swinging of the positioning lever 35 in the engagement releasing direction. As a result, it is possible to prevent occurrence of misalignment of the trailing edge regulation portion 34 on mounting of the sheet feeding cassette.

In this embodiment, a sectional shape of the stopper portion 34C of the trailing edge regulation portion 34 may be a curved shape extending along a rotation trace of the positioning lever 35 as illustrated in FIG. 6A, or may be a vertical shape as illustrated in FIG. 6B. Further, the shape in the width direction of the stopper portion 34C may be a rib-like shape or a wide wall shape.

Figure 7A:
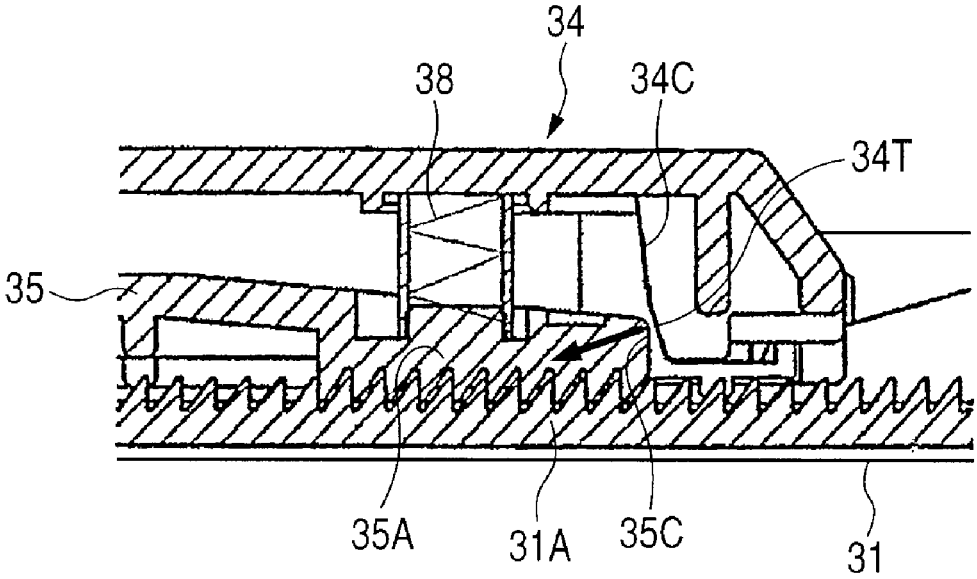
FIGS. 7A and 7B are sectional views illustrating a main part of another configuration of the sheet feeding cassette.

In addition, as illustrated in FIG. 7A, the stopper portion 34C may be provided with a tapered portion 34T, and a force can act on the positioning lever 35 in a direction indicated by the arrow of FIG. 7A (obliquely downward) when the stopper portion 34C is brought into contact with the positioning lever 35. In this case, a force having a downward component is applied to the tooth row 35A of the positioning lever 35. Therefore, meshing between the tooth row 35A of the positioning lever 35 and the rack tooth row 31A of the cassette body 22 becomes firmer, and hence it is possible to reliably prevent the engagement releasing.

Figure 7B:
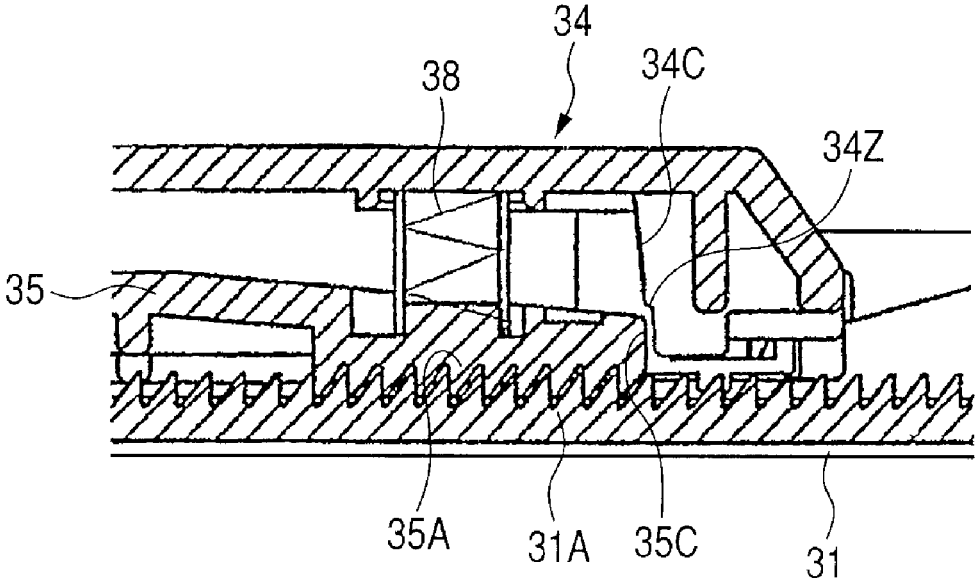

Further, as illustrated in FIG. 7B, the stopper portion 34C may be provided with a stepped portion 34Z. Owing to provision of such stepped portion 34Z, even if the positioning lever 35 is likely to swing in a direction of releasing the meshing, the leading end portion 35C of the positioning lever 35 is hooked to the stepped portion 34Z, and swinging of the positioning lever 35 is regulated. With this configuration, meshing between the tooth row 35A of the positioning lever 35 and the rack tooth row 31A of the cassette body 22 is kept, and hence it is possible to reliably prevent the disengagement.

The case where the removing-and-mounting directions of the sheet feeding cassette 21 with respect to the printer main body 2 are along the sheet feeding direction is described above. However, in a case where the removing-and-mounting directions of the sheet feeding cassette 21 are along the width direction, the above-mentioned configuration of the present invention can be applied to the side regulation portions. Thus, even when the sheet feeding cassette 21 is inserted into the printer main body 2 swiftly in the width direction, it is possible to prevent occurrence of misalignment of the side regulation portions due to the impact force.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-044044, filed Feb. 26, 2009, which is hereby incorporated by reference herein in its entirety.

What is claimed is:

1. An image forming apparatus, comprising:

a sheet feeding cassette removably mounted to an apparatus main body, and configured to contain sheets;

a sheet feeding member configured to feed a sheet from the sheet feeding cassette; and an image forming portion configured to form an image on the sheet fed out from the sheet feeding member, wherein the sheet feeding cassette comprises:

a regulation portion slidably provided in a cassette body, and configured to regulate a position of the sheet at a position according to a size of the sheet contained in the cassette body; and a fixation mechanism configured to fix the regulation portion, and wherein the fixation mechanism comprises:

a tooth row provided on the cassette body along a sliding movement direction of the regulation portion;

a holding member swingably supported to the regulation portion to be engaged with the tooth row, wherein a clearance is provided between the holding member and the regulation portion at a swing support portion of the holding member, and the regulation portion and the holding member are relatively movable in the sliding movement direction of the regulation portion in the clearance; and a stopper portion provided to the regulation portion to be contactable to the holding member, the regulation portion being moved in the sliding movement direction and the stopper portion regulating a swing movement of the holding member by contacting the holding member when a force in the sliding movement direction is applied to the regulation portion.

2. An image forming apparatus according to claim 1, wherein the stopper portion comprises an abutment portion brought into contact with the holding member, and the abutment portion is formed into a tapered shape.

3. An image forming apparatus according to claim 1, wherein the stopper portion comprises an abutment portion brought into contact with the holding member, and the abutment portion is formed into a stepped shape.

* * * * *